US005399935A

United States Patent [19]

Santonja et al.

[11] Patent Number: 5,399,935

[45] Date of Patent: Mar. 21, 1995

[54] ELECTRON GUN WITH REDUCED HEATING OF THE GRID

[75] Inventors: Noël Santonja, Creteil; Pierre-Yves Chabaud, Paris, both of France

[73] Assignee: Thomson Tubes Electroniques, Velizy, France

[21] Appl. No.: 78,825

[22] Filed: Jun. 21, 1993

[30] Foreign Application Priority Data

Jun. 26, 1992 [FR] France ..... 92 07888

[51] Int. Cl.[6] ..... H01J 23/065

[52] U.S. Cl. ..... 313/447; 313/471

[58] Field of Search ..... 313/447–449, 313/471–472, 452, 454, 414, 299

[56] References Cited

U.S. PATENT DOCUMENTS

| | | | |
|---|---|---|---|
| 3,914,651 | 10/1975 | Washburn | 313/471 |
| 4,107,570 | 8/1978 | Washburn | 313/471 |
| 4,147,953 | 4/1979 | Esterson | 313/454 |
| 4,583,021 | 4/1986 | Herriott et al. | 313/447 |
| 4,994,709 | 2/1991 | Green et al. | 313/299 |

*Primary Examiner*—Stephen Brinich

*Attorney, Agent, or Firm*—Oblon, Spivak, McClelland, Maier & Neustadt

[57] ABSTRACT

An electron gun comprises a cathode made of an emissive material with an active face emitting electrons through a control grid that is placed before the active face but has no contact with it. The active face has emissive zones and non-emissive zones. The non-emissive zones are formed by grooves hollowed out of the emissive material. The control grid has solid parts that directly face the grooves. Application to electron guns with reduced heating of the control grid. FIG. 5 .

13 Claims, 3 Drawing Sheets

ELECTRON GUN WITH REDUCED HEATING OF THE GRID

BACKGROUND OF THE INVENTION

1. Field of the Invention

The present invention relates to electron guns with grids, especially those used to equip high-power electron tubes. These tubes are chiefly of the linear beam type, such as klystrons or travelling-wave tubes. They could also be triode or tetrode type tubes.

The guns of linear-beam tubes comprise a cathode made of an emitting material and an anode taken to a potential that is more positive than that of the cathode.

2. Description of the Prior Art

When the cathode is heated, it gives an electron beam that is directed towards the anode. To obtain a variation of the intensity of the electron beam in time, a control grid positioned between the cathode and the anode is used. It is taken to an intermediate potential between that of the cathode and that of the anode.

The control grid is bombarded by the electrons. There is an interception of the electron beam that causes major difficulties in high-power tubes. Furthermore, the control grid gets greatly heated, thus restricting the time for which the gun can be used. To eliminate the bombardment of the control grid, it is proposed to place a shadow grid in the vicinity of or in contact with the cathode. This shadow grid has the same pattern as the control grid and is often taken to the potential of the cathode. But it has been seen, in the course of use, that this shadow grid, in getting heated like the cathode, itself becomes emissive as a result of a migration of the emissive matter from the cathode. The electrons emitted by the shadow grid have aberrant paths and the electron beam converges poorly. These electrons strike the control grid and/or other constituent elements of the tube in an uncontrolled and undesirable way. In the configurations where the shadow grid is in the vicinity of the cathode, there is less risk of pollution of the shadow grid by the emissive material. However, the emission of electrons is equally well disturbed for the entire zone located between the emissive surface and the shadow grid is at the same potential.

In other configurations again, a shadow grid has been associated with circular apertures and a cathode having an emissive surface which, facing each aperture of the shadow grid, is shaped like a spherical dome. The electron beam sent is less disturbed, but the making of a gun such as this is more complicated and costlier.

The present invention proposes to overcome these drawbacks. It proposes the elimination of the shadow grid and the hollowing out in the cathode of grooves that are deep enough so that their bottom does not emit electrons. The absence of the shadow grid eliminates pollution. The grooves with a non-emissive bottom form a virtual shadow grid. The grooves are positioned so that they directly face the solid parts of the control grid. The electrons emitted by the cathode do not bombard the control grid.

SUMMARY OF THE INVENTION

The present invention proposes an electron gun comprising a cathode made of an emissive material with an active face emitting electrons through a control grid. The control grid is before the active face but has no contact with it. The cathode and the control grid contribute to the creation of an electrical field in their vicinity. The active face has emissive zones and non-emissive zones. The latter are grooves hollowed out of the emissive material. At the bottom of the grooves, the intensity of the electrical field is substantially zero and the control grid has solid parts that coincide and directly face the grooves. Preferably, the grooves have two sides facing each other, with a spacing between them that is approximately one to five times smaller than the distance between the bottom and the active face.

It is preferable that at least one groove should include, on its sides, a zone treated against electron emission, this zone being contiguous with the active face. This zone has a width which is approximately equal to the spacing between the two sides.

Preferably, to avoid disturbing the emission of electrons, the active face has at least one zone treated against electron emission around the grooves. This zone has a width of about one-tenth of the spacing between the sides of the groove.

When the material is porous, the pores may be blocked by the crushing of this material in the zone treated against electron emission. The emissive material may also be melted by laser in the zone treated against electron emission, whether it is porous or not. It may also be covered with a protective layer made of a material with a work function that is as strong as possible. The protective layer has a thickness of about one micrometer.

BRIEF DESCRIPTION OF THE DRAWINGS

Other features and advantages of the invention shall appear from the following description, illustrated by the accompanying figures, of which.

MORE DETAILED DESCRIPTION

Figure 1:
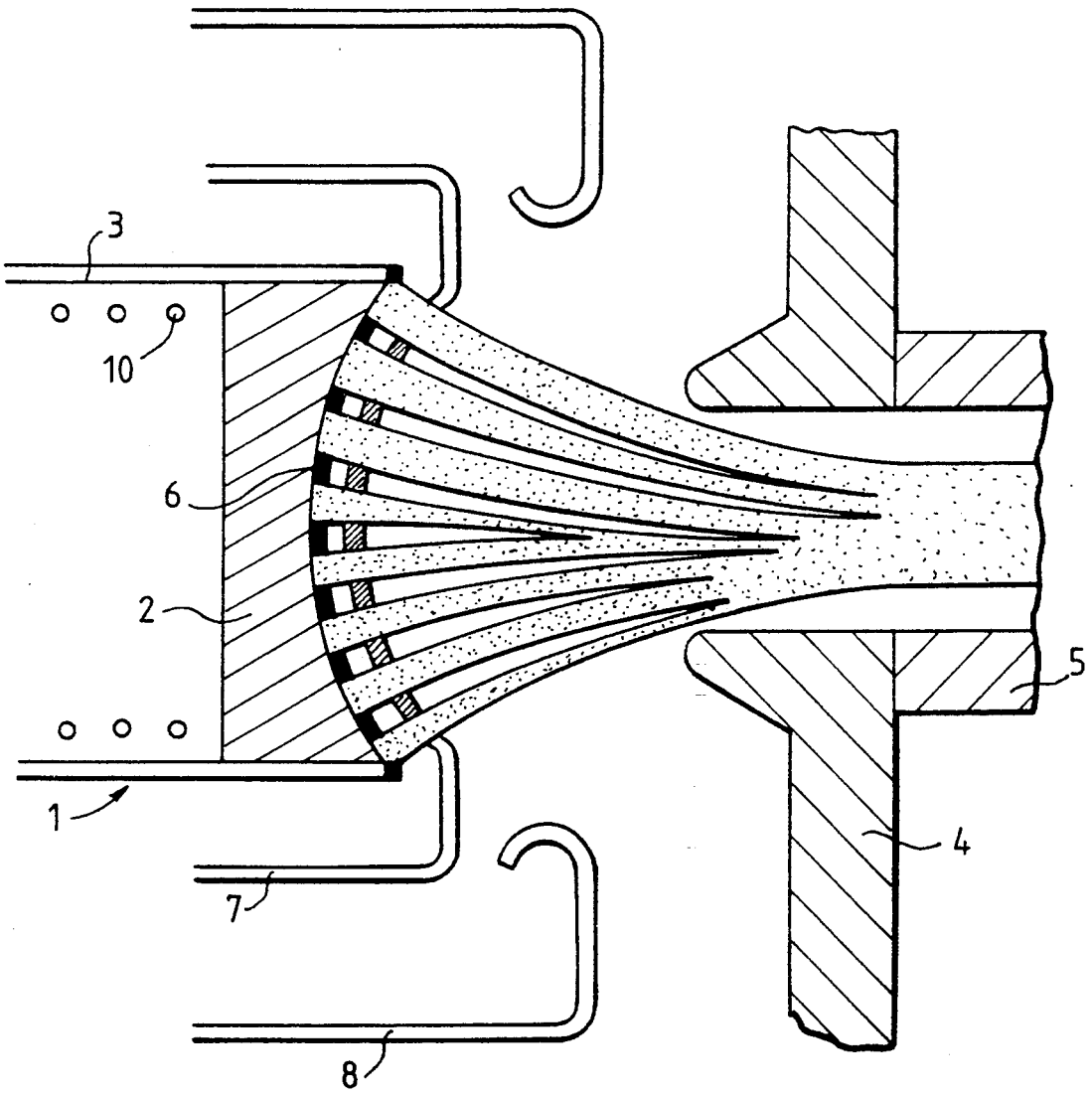
FIG. 1 shows a prior art gun.

FIG. 1 shows a longitudinal view of a known type of electron gun with grid. It comprises a cathode 1 that has a concave active face. The cathode 1 is often taken to a negative high voltage. The active face emits an electron beam when the cathode is heated. The cathode may be of the impregnated type with a porous matrix 2 (often made of tungsten) impregnated with a thermoemissive material (often consisting of barium aluminates). The matrix 2 is mounted on a skirt 3 made of refractory material. A heating filament 10 is designed to heat the porous matrix 2.

The electron beam is sent to an anode 4, open at its center, so that the electron beam can go through. After having crossed the anode 4, the electrons penetrate a tunnel-shaped user device 5 which may be the body of a microwave tube. This device does not form part of the gun. This device 5 is generally connected to a ground and ends in a collector (not shown) which collects the electrons. The anode 4 may be taken to potential of the user device 5 as in FIG. 1 or to an intermediate potential between the potential of the catbode 1 and that of the user device 5. Grids and a focusing electrode or Wehnelt device may be inserted between the cathode 1 and the anode 4. In FIG. 1, between the cathode 1 and the anode 4, two grids 6, 7 and a Wehnelt device 8 are encountered successively.

The Wehnelt device 8 contributes to focusing the electron beam. One of the grids 6 is a shadow grid. It is in contact with the active face of the cathode 1. It is taken to the same potential as the cathode. The shadow grid 6 is pierced with apertures. The electrons are emitted through these apertures in the form of elementary beams. Between the shadow grid 6 and the Wehnelt device 8, there is a control grid 7. The control grid 7 is taken to an intermediate potential between that of the cathode I and that of the anode 4. This control grid 7 has apertures that are aligned with those of the shadow grid 6. However, the apertures of the control grid 7 are often slightly wider than those of the shadow grid 6. The control grid 7 may be used for the pulse modulation of the electron beam when the gun is designed to function in pulsed mode or to adjust the current of the gun when it is designed to work in continuous mode. The two grids 6, 7 are substantially parallel and follow the curvature of the active face of the cathode 1. The shadow grid 6 introduces aberrations in the electron beam for it ultimately gets polluted by the emissive material and starts emitting electrons. Some electrons emitted by it bombard the control grid 7 which gets heated up in turn, while others have disturbed paths.

Figure 2:
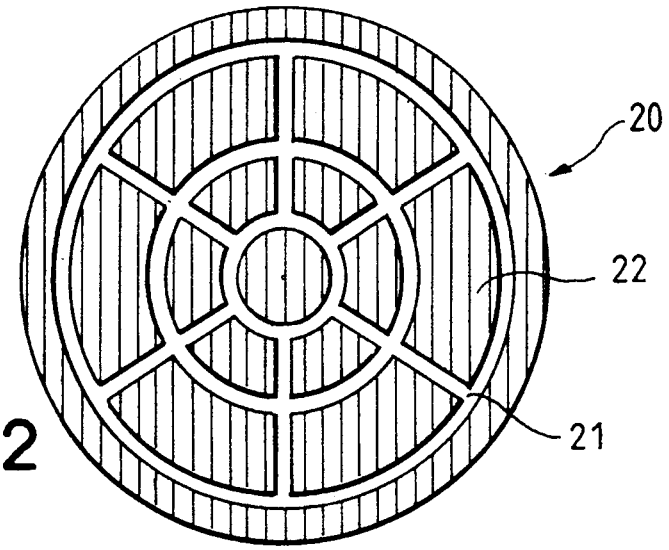
FIG. 2 shows a front view of a cathode of a gun according to the invention.

FIG. 2 shows a front view of an active face 20 of a cathode of a gun according to the invention. It is assumed that the cathode is formed by a matrix made of emissive material. The active face 20 has emissive zones 22 that are hatched in the figure and non-emissive zones 21 that are not hatched. The non-emissive zones 21 are grooves hollowed out of the emissive material.

Figure 3:
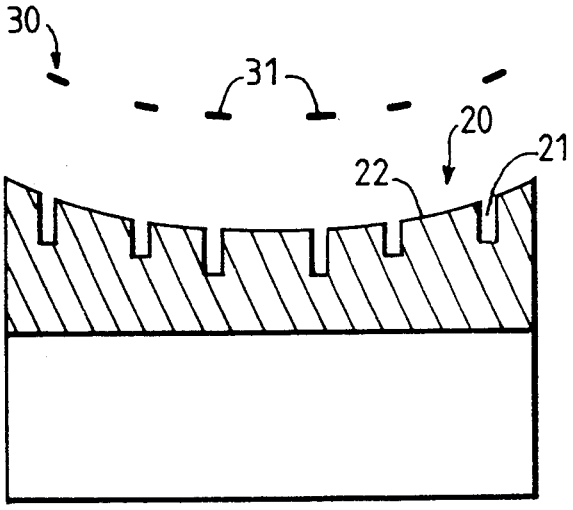
FIG. 3 shows a sectional view of a cathode and of a control gate of a gun according to the invention.

FIG. 3 shows a transversal sectional view of the cathode of FIG. 2 associated with a control grid 30 placed in the vicinity of the active face 20 of the cathode. The control grid 30 has bars 31 with a pattern corresponding to that of the grooves 21. The grooves 21 directly face the bars 31 of the control grid 30. The control grid 30 is taken to a potential that is more positive than that of the cathode. The control grid and the cathode contribute to creating an electrical field in their vicinity.

Figure 4:
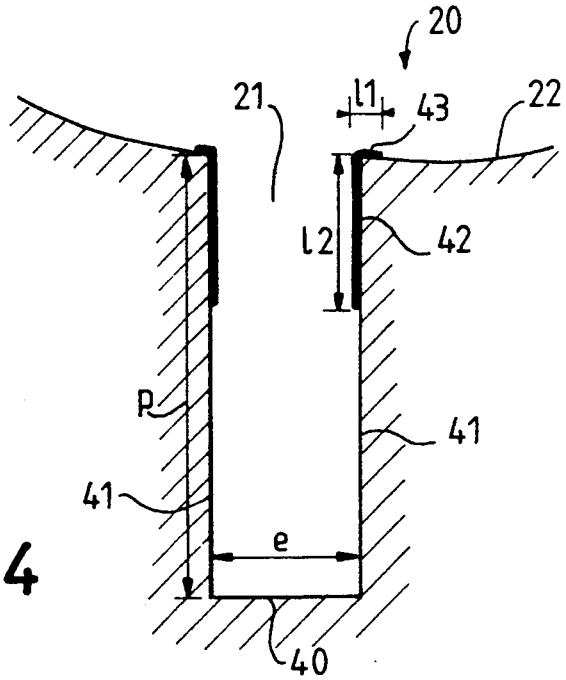
FIG. 4 shows a detailed view of a groove.

FIG. 4 shows a detailed view of a groove 21. It is formed by a bottom 40 and two sides 41 that face each other. The two sides 41 preferably form a right angle with the bottom 40. The grooves are non-emissive zones for the bottom 40 of the grooves emits no electrons. The grooves are dimensioned and positioned with respect to the control grid 30 so that the intensity of the electrical field is substantially zero at the bottom 40 of the grooves. On the sides 41 of the grooves, the intensity of the electrical field is far lower than that existing at the active face 20 of th cathode. There is practically no electron emission at the sides 41 of the grooves 21.

To make an electron gun according to the invention, using a modulation grid similar to those used in prior art guns, the grooves 21 will preferably be given a depth p of the order of one to five times the distance e between their two sides 41.

This distance e corresponds substantially to the dimension of the cross-section of the bars 31 of the control grid 30, this dimension being measured parallel to the active face 20 of the cathode. These dimensions are only examples, and are in no way restrictive.

It may be the case that a slight level of parasitic electron emission persists on the sides 41 of the grooves 21 opposite the bottom 40 in the zones 42 adjoining the active face 20. To get rid of this parasitic transmission if any, several variants are possible. If the cathode is formed by a porous matrix impregnated with a thermoemissive material, the pores may be blocked by crushing the porous material. The porous material is made of tungsten and it is often brittle. The working of the tungsten with an appropriately shaped tool closes the pores and eliminates the emission of electrons in the treated zone.

The zones treated against electron emission may also be melted by laser, whether or not the material is porous. The laser beam is shifted along the zones to be treated. If the cathode has pores, they are blocked by melting.

A third variant consists in covering the zones to be treated against electron emission with a protection layer. The protection layer will be made of a material having a work function that is as high as possible. A material with a high work function can emit electrons only in the presence of a strong electrical field. This material may be, for example, tungsten, molybdenum dilisilicide or a carbide of a refractory metal or one of their alloys or mixtures. The refractory materials are, for example, tungsten, molybdenum or tantalum. The thickness of the layer deposited will advantageously be of the order of one micrometer. The deposition will be done by evaporation or by a physical/chemical process in a controlled atmosphere: it will be, for example, a vapor phase deposition or a vacuum deposition. It is possible to use a mask having apertures that correspond to the zones to be treated against the electron emission and solid parts that correspond to the zones to be shielded.

So that the electrons emitted may have paths that are as little disturbed as possible, it will also be useful to provide zones 43 of the active face 20 of the cathode, located on the edge of the grooves, with treatment against electron emission. These zones 43 on the edge of the grooves are normally emissive. However, they may be geometrically ill-defined owing to the brittleness of the porous matrix. The paths of the electrons coming from these zones may be disturbed.

The zones 42 treated against the electron emission from the sides of the grooves 21 will have an approximate width 12 from the active face 20, this width 12 being substantially equal to the distance e between the two sides 41 of the grooves.

The zones 43 treated against the electron emission from the active face 20 will have a width 11 from the edge of the groove that is substantially equal to one-tenth of the distance e.

Figure 5:
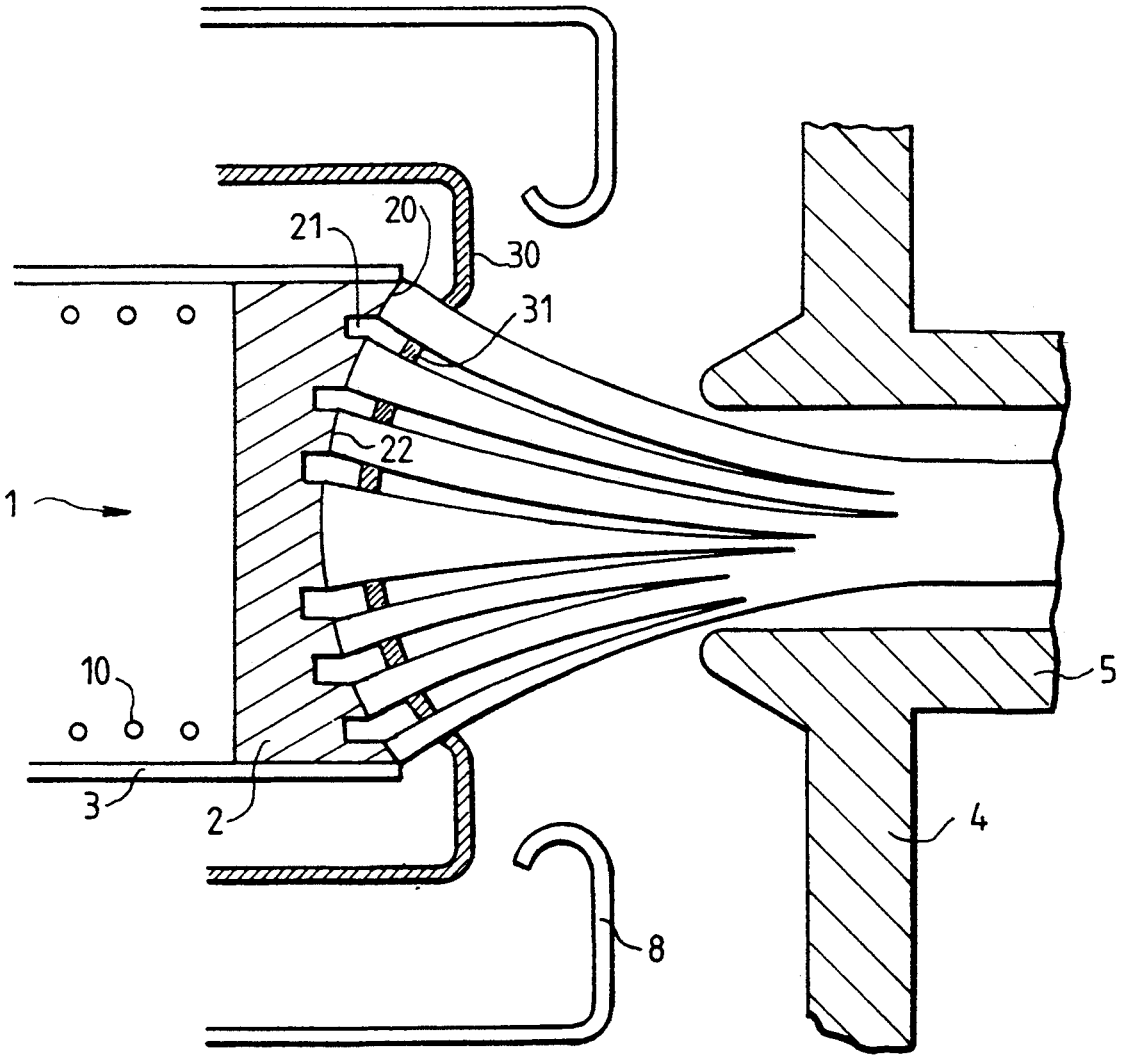
FIG. 5 shows a sectional view of a gun according to the invention.

FIG. 5 shows a sectional view of a gun according to the invention. It is comparable to the gun of FIG. 1. The figure shows a cathode 1 facing an anode 4, a Wehnelt device 8 and a control grid 30, but in accordance with the invention, the shadow grid has been eliminated.

The active face 20 of the cathode has emissive zones 22 and non-emissive zones formed by grooves 21, the bottom of which is subjected to a substantially zero electrical field. The control grid 30 has bars 31 that directly face the grooves 21 since there is no longer any shadow grid. The risk of bombardment of the control grid 30 is considerably reduced by means of the non-emissive grooves 21.

Other embodiments of a gun according to the invention are quite possible, and the examples given are in no way restrictive.

What is claimed is:

1. An electron gun comprising a cathode made of an emissive material with an active face emitting electrons through a control grid placed before the active face but having no contact with it and carried to a potential different from that of the cathode, the cathode and the control grid contributing to the creation of an electrical field, wherein the active face comprises emissive zones and non-emissive zones, the non-emissive zones being formed by grooves hollowed out of the emissive material, the electrical field having an intensity that is substantially zero at the bottom of the grooves, and wherein the control grid has solid parts that coincide with a projection of each of corresponding ones of said grooves in the direction of said cathode and said solid parts directly face the corresponding grooves.

2. An electron gun according to claim 1, wherein the grooves, between the bottom and the active face, have two sides facing each other, with a spacing between them that is approximately one to five times smaller than the distance between the bottom and the active face.

3. An electron gun according to any of the claims 1 or 2, wherein at least one groove includes a zone treated against electron emission, said zone being contiguous with the active face.

4. An electron gun according to claim 3, wherein the zone treated against electron emission has a width from the active face that is substantially equal to the spacing between the sides of the groove.

5. An electron gun according to claim 1, wherein the active face has at least one zone treated against electron emission said zone located on the edge of a groove.

6. An electron gun according to claim 5, wherein the zone treated against electron emission has a width, from the edge of the groove, that is substantially equal to one-tenth of the spacing between the sides of the groove.

7. An electron gun according to claim 3, wherein the emissive material has pores blocked by the crushing of this material with an appropriate tool in the zone treated against electron emission.

8. An electron gun according to claim 3, wherein the emissive material is melted by laser in the zone treated against electron emission.

9. An electron gun according to claim 3, wherein the emissive material is covered with a protective layer in the zone treated against electron emission.

10. An electron gun according to claim 9, wherein the protective layer is made of a material with a high work function therefor.

11. An electron gun according to claim 10, wherein the material with a work high function is chosen from among tungsten, molybdenum disilicide, a carbide of a refractory metal or one of their alloys or mixtures.

12. An electron gun according to claim 9, wherein the protective layer is deposited by evaporation.

13. An electron gun according to claim 9, wherein the protective layer has a thickness of about one micrometer.

* * * * *